United States Patent [19]

Lampman

[11] 4,111,329

[45] Sep. 5, 1978

[54] CONTAINER WITH TAMPERPROOF AND STACKABLE LID

[76] Inventor: John Edward Lampman, 117 W. Walnut Ave., Moorestown, N.J. 08057

[21] Appl. No.: 834,113

[22] Filed: Sep. 19, 1977

[51] Int. Cl.[2] ..... B65D 41/32

[52] U.S. Cl. ..... 220/266; 220/306; 220/380; 215/256; 206/508

[58] Field of Search ..... 215/256; 220/270, 266, 220/306, 380, 274, 276, 284; 206/508

[56] References Cited

U.S. PATENT DOCUMENTS

| | | | |
|---|---|---|---|
| 3,373,896 | 3/1968 | Davis | 206/508 X |
| 3,837,518 | 9/1974 | Gach | 215/256 X |
| 3,979,003 | 9/1976 | Allen | 215/256 |

*Primary Examiner*—George T. Hall
*Attorney, Agent, or Firm*—George H. Gerstman

[57] ABSTRACT

A tamperproof container and cap assembly in which the container carries a circumferential radially extending flange which cooperates with the skirt of the cap to prevent the cap from being removed until a portion of the cap skirt is removed. The cap skirt comprises an upper portion and a lower portion, with the lower portion forming a tear-off strip that is connected to the upper portion by means of vertically oriented stacking ribs. The ribs are dimensioned so as to allow a plurality of caps to be stacked upon one another. The lower portion of the skirt defines an opening which enables an operator to insert a tool therein and then to tear the lower portion away from the upper portion.

12 Claims, 9 Drawing Figures

FIG. 1
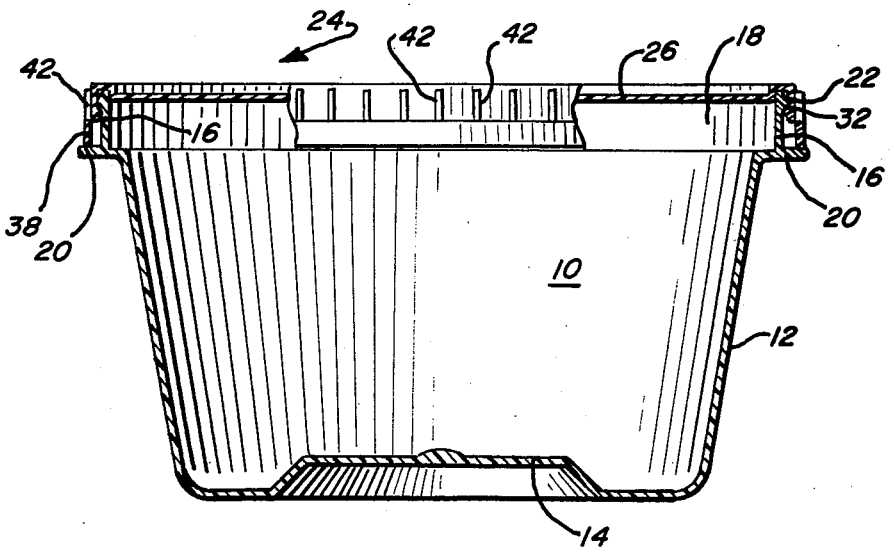
FIG. 2
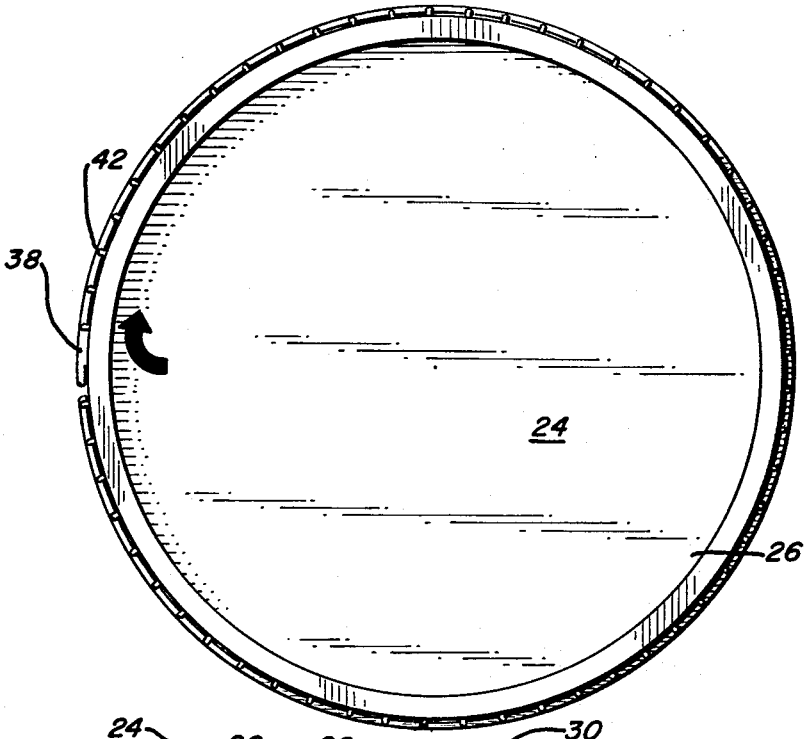
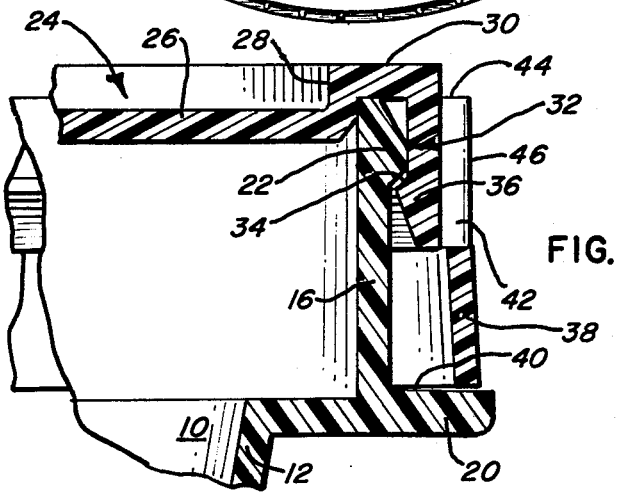
FIG. 3

FIG. 4
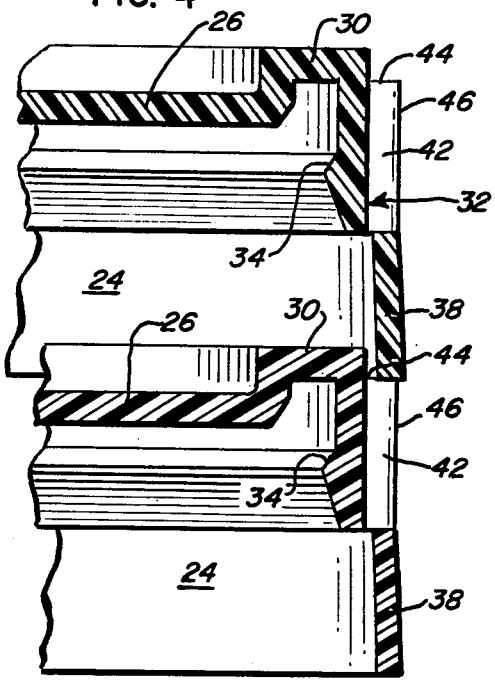
FIG. 5
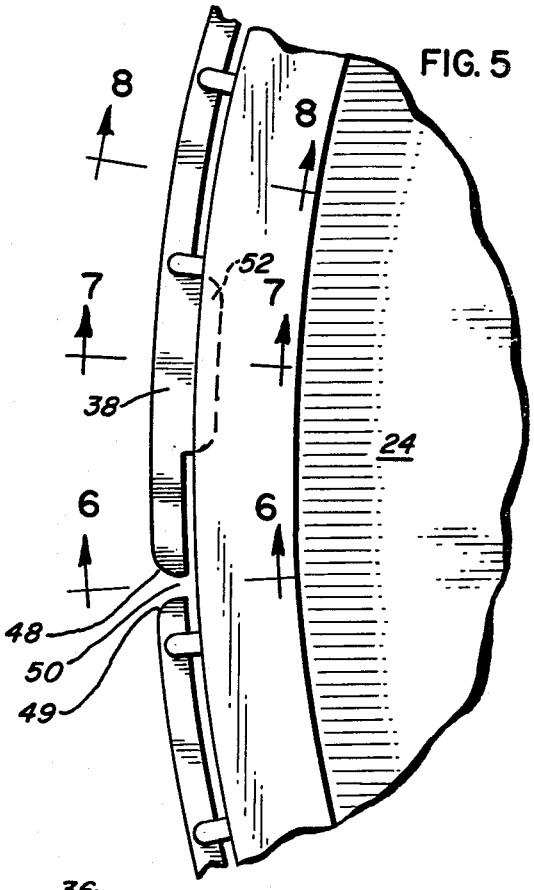
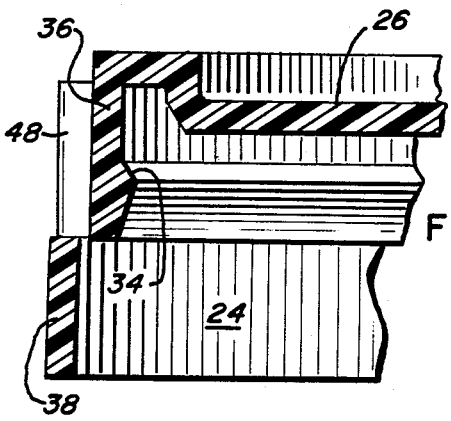
FIG. 6
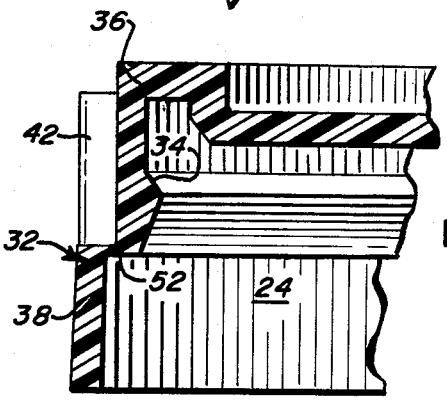
FIG. 7
FIG. 8
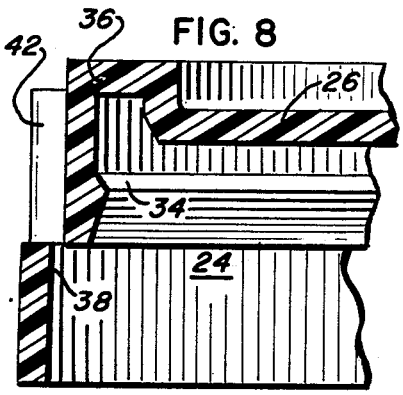
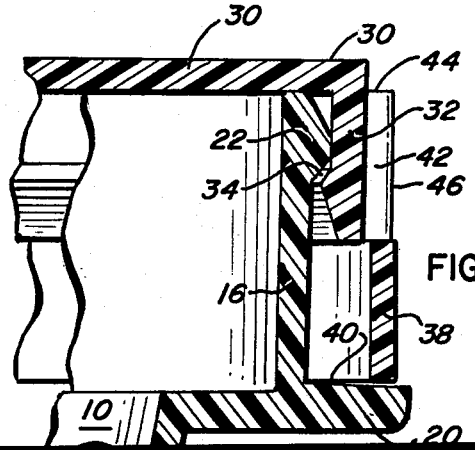
FIG. 9

CONTAINER WITH TAMPERPROOF AND STACKABLE LID

BACKGROUND OF THE INVENTION

This invention concerns a tamperproof container and cap assembly, and more particularly, an assembly in which once the cap and container are assembled, a portion of the cap must be torn away in order for the cap to be readily removed from the container.

Many types of tamperproof container and cap assemblies are in use today. For example, the prior art container and closure assembly disclosed in Stubbs, Jr. U.S. Pat. No. 4,037,748 includes a cap having a tear-away portion which, after being torn away, permits simple removal of the cap from the container. The cap disclosed in the Stubbs, Jr. patent enables manual grasping of the tear strip for removal thereof. This enables persons at the point of purchase to remove the tear strip without tools, which in certain instances is undesirable. In addition, the Stubbs, Jr. tear strip includes a projecting tab which is grasped by the operator. This protruding tab prevents the cap from being handled on conventional packing equipment which utilizes spinning rods.

Other types of prior art assemblies are not really tamperproof because access to the most downwardly extending portion of the cap is readily accessible, thereby allowing the cap to be pried up and removed from the container without first tearing the tear strip. Two examples of such systems are disclosed in Rowe, et al. U.S. Pat. No. 3,831,798 and Carvalho U.S. Pat. No. 1,685,227. The type of systems disclosed in these patents may not be considered tamperproof systems because there is no positive evidence that the system has been tampered with if the cap is removed without first tearing off the tear strip.

One type of system in which there is positive evidence of tampering is disclosed in Acton, et al. U.S. Pat. No. 3,913,771. Acton, et al.'s container carries a radially extending circumferential flange which cooperates with the tamper indicating band to prohibit access to the cap until the tamper indicating band is removed. Acton, et al.'s cap is designed for a glass jar and incorporates a metal disc surrounded by a plastic ring having the "tamper indicative" feature. The Acton, et al. closure cap requires complex tooling and for certain applications might be considered unattractive in appearance.

It is an object of the present invention to provide a container and cap assembly which is simple in construction and easy to manufacture.

Another object of the present invention is to provide a container and cap assembly which is tamper-indicative, that is, which requires that a tear strip be removed before the cap can be removed from the container.

A further object of the present invention is to provide a container and cap assembly in which a plurality of caps are readily stackable.

A still further object of the present invention is to provide a container and cap assembly in which there are no protruding elements extending from the cap skirt. By obviating protruding elements, the cap may be handled by conventional packing equipment which utilizes spinning rods. The spinning rods require that the circumference of the lid be smooth with no outward projection. The use of spinning rods is significant in enabling the manufacturer to collect the caps, orient them automatically and pack them. The use of spinning rods is also important in enabling the manufacturer to automatically dispense the caps to a printing machine and again collect and pack the caps. The ability to use spinning rods is also significant to customers who can utilize conventional packaging equipment to automatically dispense and apply caps to containers.

Another object of the present invention is to provide a tamperproof container and cap assembly, in which the cap cannot be removed manually at the point of purchase, but instead a tool is required in order to remove the cap.

A further object of the present invention is to provide a container and cap assembly which is attractive in appearance and simple in operation.

Other objects and advantages of the invention will become apparent as the description proceeds.

SUMMARY OF THE INVENTION

In accordance with the present invention, a container and cap assembly are provided including a container having an opening defined by an annular rim, a cap having a closed top portion and an annular skirt depending therefrom, the skirt having an internal dimension cooperative with the external dimension of the annular rim so as to overlie the annular rim snugly. The improvement comprises a peripheral flange carried by the rim and extending radially outward therefrom. The peripheral flange is positioned to underlie the annular skirt and be adjacent thereto so as to prevent lifting of the cap off the rim when the cap is in a closed position on the rim and overlying the peripheral flange.

The skirt comprises an upper portion and a lower portion with the lower portion being adapted to be torn away from the upper portion by an operator to enable access to the skirt, thereby permitting the cap to be removed from the container.

In the illustrative embodiment, a plurality of frangible ribs connect the upper portion of the skirt to the lower portion thereof. Means are provided for enabling access to the lower portion, with the enabling means being dimensioned so as not to protrude from the lower portion.

In the illustrative embodiment, each of the frangible ribs has a generally vertical orientation and the frangible ribs are spaced about the periphery of the skirt. The frangible ribs have a generally planar top extending radially from the upper portion of the skirt at a plane below the highest plane of the top portion of the cap, thereby enabling easy stacking of a plurality of caps.

In the illustrative embodiment, the enabling means comprises the walls of the lower portion which define an opening in the lower portion. The defined opening comprises a vertically oriented slit into which a tool is adapted to be inserted by an operator, thereby enabling the lower portion to be broken away from the upper portion.

A more detailed explanation of the invention is provided in the following description and claims, and is illustrated in the accompanying drawings.

BRIEF DESCRIPTION OF THE DRAWINGS

FIG. 1 is an elevational view, with portions being broken for clarity and with portions illustrated in cross-section for clarity, of a container and cap assembly constructed in accordance with the principles of the present invention;

FIG. 2 is a top plan view of a cap constructed in accordance with the principles of the present invention;

FIG. 3 is a fragmentary enlarged view of the upper right-hand portion of FIG. 1;

FIG. 4 is a fragmentary enlarged view of two stacked caps;

FIG. 5 is a fragmentary enlarged view of a portion of FIG. 2;

FIG. 6 is a cross-sectional view taken along the plane of the line 6—6 of FIG. 5;

FIG. 7 is a cross-sectional view taken along the plane of the line 7—7 of FIG. 5;

FIG. 8 is a cross-sectional view taken along the plane of the line 8—8 of FIG. 5; and FIG. 9 is a fragmentary view similar to FIG. 3, but showing a cap having a flat top configuration.

DETAILED DESCRIPTION OF THE ILLUSTRATIVE EMBODIMENT

Referring to the drawings and to FIG. 1 in particular, a container 10 is shown therein including a sidewall portion 12, a dished bottom 14, and an annular rim portion 16 at the top of the sidewall portion 12 and defining a circular opening 18 at the top of the container 10. The junction of sidewall 12 and rim 14 of the container 10 carries a circumferential radially extending flange 20. Adjacent the top of rim 16 there is a radially extending cap-engaging circumferential bead 22.

As shown most clearly in FIGS. 1, 2 and 3, the cap, generally designated by reference numeral 24, includes a top closure portion 26, an annular inner wall 28, a top wall 30 and a circumferential skirt 32. In the FIGS. 1 and 3 embodiment, inner wall 28, top wall 30 and circumferential skirt 32 have a generally inverted U-shape configuration with the external diameter of the inner wall 28 being such that it forms a plug fit with the internal diameter of the container. In the FIG. 9 embodiment, top wall 30 is planar in order to allow the cap to accept a membrane seal of foil or other suitable material, prior to capping.

The interior of skirt 32 defines a circumferential shoulder 34 for cooperation with annular bead 22. When the cap is in its closed position upon the container, as shown in FIG. 3 shoulder 34 underlies the bottom portion of bead 22 thereby enhancing the connection of the cap to the container.

Cap 32 comprises an upper portion 36 which carries shoulder 34, and a lower portion 38. The cap is dimensioned so that lower portion 38 will rest upon horizontal shelf 40 of circumferential flange 20 when the cap 24 is connected to the container 10. In this manner, the operator cannot remove the cap 24 from the container 10 without first removing lower portion 38 from the cap.

Lower portion 38 is connected to upper portion 36 by means of a plurality of equally-circumferentially spaced ribs 42. Ribs 42 have a generally rectilinear configuration and are generally vertically oriented. The top 44 of each rib 46 is generally planar and lies in a horizontal plane that is below the horizontal plane of top portion 30. Ribs 42 extend radially outwardly with the outward extremity 46 being generally aligned with the plane of the outer surface of lower portion 38.

As shown most clearly in FIG. 4, the dimensioning of the ribs 42 as described above permits a plurality of caps 24 to be stacked, one above the other. It can be seen that the bottom of lower portion 38 will rest upon the top 44 of the ribs carried by the underlying container cap.

The means for enabling removal of lower portion 38 are shown most clearly in FIGS. 5–8. Referring to FIG. 5 in particular, it can be seen that curved walls 48, 49 of lower portion 38 define an opening 50 into which a tool can be inserted. In addition to the connection of lower portion 38 to upper portion 36 by means of ribs 42, a membrane 52 is provided proximate wall 48 connecting lower portion 38 to upper portion 36. As shown in FIG. 7, membrane 52 primarily lies in a horizontal plane and is preferably about 0.005 inch in thickness. In order for the lower portion 38 to be removed, the operator inserts a tool, such as a spoon, into opening 50 and behind wall 48. Using the tool as a lever, the operator breaks membrane 52 to release a part of lower portion 38 from upper portion 36. The released part of lower portion 38 is then grasped and pulled circumferentially about the cap, thereby tearing frangible ribs 42 until the lower portion 38 is completely removed from the cap. The operator can then simply insert his thumb in the volume which was blocked by lower portion 38 before removal thereof, and by lifting up on the underside of upper portion 36 of the cap, the cap can be removed from the container.

It can be seen that a container and cap assembly has been provided in which evidence of tampering is presented once the cap has been removed from the container. Further, the caps can be readily stacked by utilizing the vertically oriented ribs which connect the upper portion of the cap skirt to the lower portion thereof. Also, there is no projection from the cap skirt, and thus the cap may be handled on conventional packing equipment utilizing spinning rods. The cap and container assembly are attractive in appearance and are easy to manufacture and use.

Although illustrative embodiments of the invention have been shown and described, it is to be understood that various modifications and substitutions may be made by those skilled in the art without departing from the novel spirit and scope of the present invention.

What is claimed is:

1. A container and cap assembly, including a container having an opening defined by an annular rim; a cap having a closed top portion and an annular skirt depending therefrom, said skirt having an internal dimension cooperative with the external dimension of said annular rim so as to overlie said annular rim snugly, the improvement comprising, in combination: a peripheral flange carried by said rim and extending radially outwardly therefrom, said peripheral flange being positioned to underlie said annular skirt and be adjacent thereto so as to prevent lifting of said cap off said rim when said cap is in a closed position on said rim and overlying said peripheral flange; said skirt comprising an upper portion and a lower portion with the lower portion being adapted to be torn away from the upper portion by an operator to enable access to the skirt, permitting the cap to be removed from the container; a plurality of frangible ribs connecting the upper portion of the skirt to the lower portion thereof, said frangible ribs extending radially outwardly from the upper portion; and means for enabling access to the lower portion, said enabling means being dimensioned so as not to protrude from the lower portion.

2. A container and cap assembly as described in claim 1, each of said frangible ribs having a generally vertical orientation with said frangible ribs being spaced about the periphery of said skirt.

3. A container and cap assembly as described in claim 1, each of said frangible ribs having a generally planar top extending radially from the upper portion of the skirt at a plane below the highest plane of the top portion of the cap.

4. A container and cap assembly as described in claim 1, each of said frangible ribs having a generally vertical orientation and extending radially outwardly from said upper portion with the outer radial extremity of each rib substantially lying in the plane of said lower portion.

5. A container and cap assembly as described in claim 1, said enabling means comprising the walls of said lower portion which define an opening in said lower portion.

6. A container and cap assembly as described in claim 5, said defined opening comprising a vertically oriented slit into which a tool is adapted to be inserted by an operator, thereby enabling said lower portion to be broken away from said upper portion.

7. A container and cap assembly as described in claim 5, said enabling means further comprising a membrane connecting said lower portion to said upper portion, said membrane being located only a small portion of the distance about the circumference of the skirt and proximate said opening.

8. A container and cap assembly, including a container having an opening defined by an annular rim; a cap having a closed top portion and an annular skirt depending therefrom, said skirt having an internal dimension cooperative with the external dimension of said annular rim so as to overlie said annular rim snugly, the improvement comprising, in combination: a peripheral flange carried by said rim and extending radially outwardly therefrom, said peripheral flange being positioned to underlie said annular skirt and be adjacent thereto so as to prevent lifting of said cap off said rim when said cap is in a closed position on said rim and overlying said peripheral flange; said skirt comprising an upper portion and a lower portion with the lower portion being adapted to be torn away from the upper portion by an operator to enable access to the skirt, permitting the cap to be removed from the container; a plurality of vertically oriented frangible ribs connecting the upper portion of the skirt to the lower portion thereof, each of the frangible ribs being spaced about the periphery of said skirt, each of said frangible ribs extending radially outwardly from the upper portion and having a generally planar top extending radially from the upper portion of the skirt at a plane below the highest plane of the top portion of the cap; and means for enabling access to said lower portion, said enabling means being dimensioned so as not to protrude from the lower portion and comprising the walls of said lower portion which define an opening in said lower portion, said defined opening comprising a vertically oriented slit into which a tool is adapted to be inserted by an operator, thereby enabling said lower portion to be broken away from said upper portion.

9. A container and cap assembly as described in claim 8, each of said frangible ribs extending radially outwardly from said upper portion with the outer radial extremity of each rib substantially lying in the plane of said lower portion.

10. A container and cap assembly as described in claim 8, said enabling means further comprising a membrane connecting said lower portion to said upper portion, said membrane being located only a small portion of the distance about the circumference of the skirt and proximate said opening.

11. A container and cap assembly, including a container having an opening defined by an annular rim; a cap having a closed top portion and an annular skirt depending therefrom, said skirt having an internal dimension cooperative with the external dimension of said annular rim so as to overlie said annular rim snugly, the improvement comprising, in combination: a peripheral flange carried by said rim and extending radially outwardly therefrom, said peripheral flange being positioned to underlie said skirt and be adjacent thereto so as to prevent lifting of said cap off said rim when said cap is in a closed position on said rim and overlying said peripheral flange; said skirt comprising an upper portion and a lower portion with the lower portion being adapted to be torn away from the upper portion by an operator to enable access to the skirt, permitting the cap to be removed from the container; and a plurality of frangible vertically oriented stacking ribs connecting the upper portion of the skirt to the lower portion thereof, said frangible ribs extending radially outwardly from the upper portion.

12. A container and cap assembly as described in claim 11, including means for enabling access to the lower portion, said enabling means being dimensioned so as not to protrude from the lower portion.

* * * * *